United States Patent [19]

Bergmark et al.

[11] 4,083,362

[45] Apr. 11, 1978

[54] KITCHEN VENTILATOR HAVING A DOWNWARDLY DIRECTED AIR CURTAIN

[75] Inventors: Nils Randolf Bergmark; Thord Ingvar Eugen Westermark, both of Byske, Sweden

[73] Assignee: Futurumverken AB, Byske, Sweden

[21] Appl. No.: 737,194

[22] Filed: Oct. 29, 1976

[30] Foreign Application Priority Data

Nov. 5, 1975 Sweden ..... 7512386

[51] Int. Cl.[2] ..... F24C 15/08; F23J 11/00

[52] U.S. Cl. ..... 126/299 D; 55/DIG. 36; 98/36

[58] Field of Search ..... 126/299 D; 98/36; 55/DIG. 36

[56] References Cited

U.S. PATENT DOCUMENTS

| | | | |
|---|---|---|---|
| 2,664,808 | 1/1954 | Peterson | 126/299 D |
| 2,886,124 | 5/1959 | Scharmer | 126/299 D |
| 3,589,266 | 6/1971 | Hike et al. | 126/299 D |
| 3,719,137 | 3/1973 | Gould | 126/299 D |

FOREIGN PATENT DOCUMENTS

| | | | |
|---|---|---|---|
| 1,251,741 | 4/1969 | United Kingdom | 126/299 D |
| 1,137,904 | 12/1968 | United Kingdom | 126/299 D |

*Primary Examiner*—Ronald C. Capossela

*Attorney, Agent, or Firm*—Cushman, Darby & Cushman

[57] ABSTRACT

A kitchen ventilator has a first outlet for connection to an evacuation duct and a second outlet for recirculation air. The pressure side of the fan is connected to these outlets by means of a valve. A duct from the valve to a odor removal filter adjacent the second outlet forms a plenum chamber, the bottom of which is the bottom wall of the ventilator housing. In this bottom wall openings are provided for producing a downwards flowing air curtain only when the valve is set for recirculation.

5 Claims, 6 Drawing Figures

KITCHEN VENTILATOR HAVING A DOWNWARDLY DIRECTED AIR CURTAIN

The present invention relates to a kitchen ventilator according to the preamble of the accompanying claim 1.

When a kitchen ventilator is used for recirculation of filtered air within the room in which it is placed, problems connected with disturbing air flows arise, especially when the outlet opening for the recirculation air is situated on the upper side of the kitchen ventilator housing. The air flow coming from the outlet opening may produce an upwardly directed air flow even below the bottom plane of the kitchen ventilator so that vapors from the kitchen stove are drawn out and do not pass through the kitchen ventilator. The purpose of the present invention is to, with the help of per se known blowing of air downwards from the bottom side of the kitchen ventilator so as to produce an air curtain, counteract the lateral flow of vapors from the stove beyond and outside of the kitchen ventilator. The air curtain arrangement shall be designed so that the kitchen ventilator obtains the best overall efficiency.

According to the invention, this is achieved with a kitchen ventilator having the characteristics disclosed in the enclosed claim 1.

Since the air to the air curtain is taken from between the valve and the odor-removal filter, the air curtain will only be formed wehen needed, that is, when the kitchen ventilator is used for recirculation of filtered air. When the kitchen ventilator is used for evacuation of room air, no upwardly directed air flow past the kitchen ventilator arises. Thus, no downwardly directed air curtain is needed. Thus, all of the air taken in by the kitchen ventilator can be evacuated. Furthermore, in terms of construction a technically advantageous solution is obtained by means of the air being taken from the air flow path in front of the odor removal filter as, in this manner, the superatmospheric pressure which normally prevails at this point is taken advantage of.

Further properties and advantages of the invention are revealed by the following description of an embodiment in the form of a kitchen ventilator intended for both evacuation and recirculation. Reference is made to the accompanying drawings.

Figure 1:
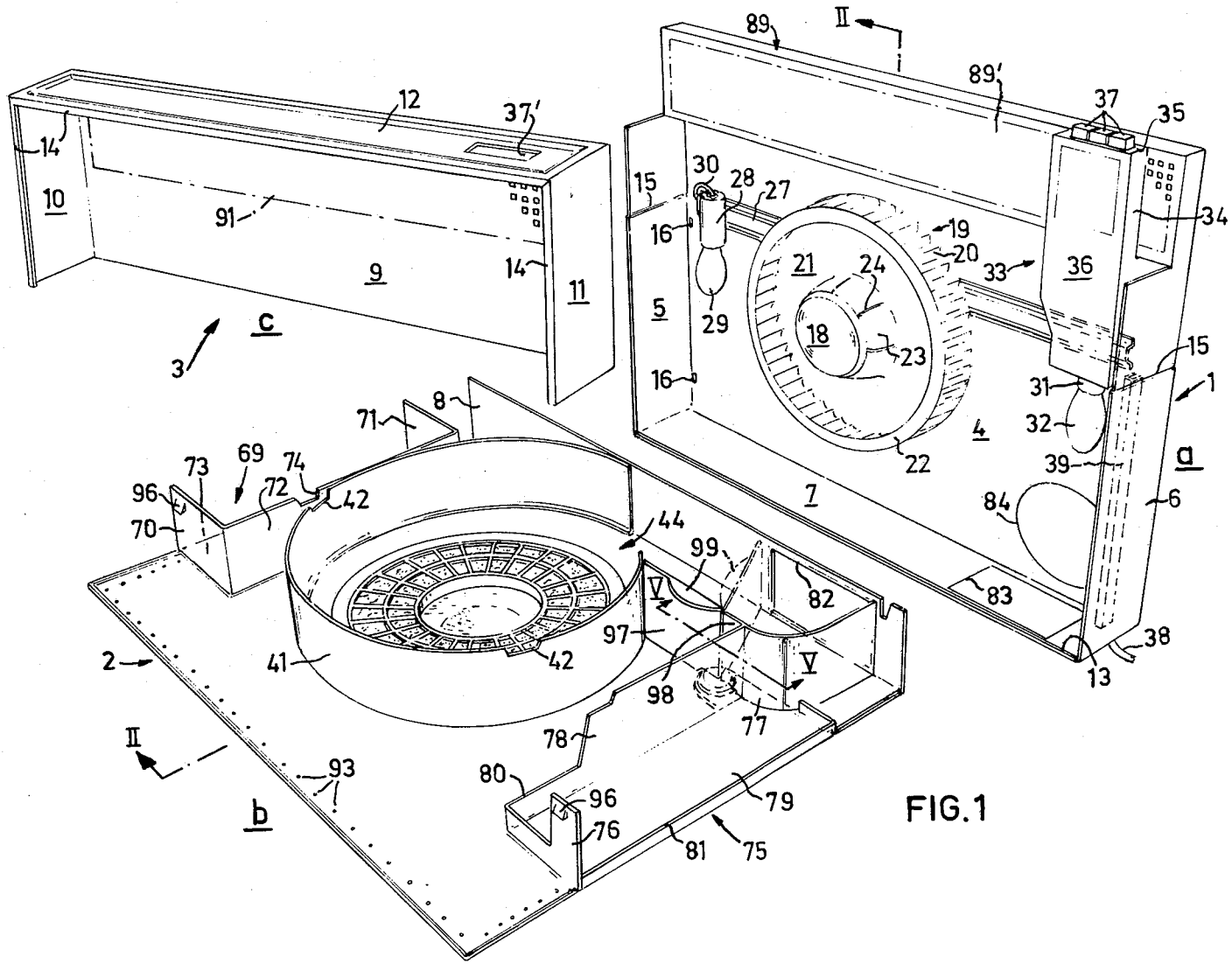
FIG. 1 is a perspective view of the kitchen ventilator disassembled into its three main components, FIG. 1*a* showing the upper section, FIG. 1*b* showing the bottom plate and FIG. 1*c* illustrating the front cover.

The kitchen ventilator is built up of three substantially metal plate main components: an upper section 1, a bottom plate 2 and a front cover 3. In the assembled state, these three main components form a box-like kitchen ventilator having six flat sides. The upper section 1 consists of a downwardly open box having an upper wall 4 and side and back walls 5, 6 and 7, respectively, projecting vertically downwards from said upper wall. The bottom plate 2 is designed as an essentially flat plate having a vertically upwardly projecting rear wall 8. The front cover 3 is designed as a downwardly and backwardly open box having an upper wall 9 and side and front walls 10, 11 and 12, respectively, projecting vertically downwards from said upper wall 9. In the operational position, the bottom plate 2 is supported at its rear edge by a narrow metal plate ledge 13 which projects horizontally out from the bottom edge of the rear wall 7 of the upper section 1. In the front, the bottom plate 2 is supported by the front cover 3, the side and front walls 10 - 12 of which have a horizontally inwardly directed metal plate ledge 14 extending along the lower edge of the front cover. When the front cover 3 is slid onto the upper section 1, the metal ledge 14 engages the bottom plate 2 along its front edge and the forward parts of its side edges and thereby supports the same. The upper wall 4 and the side walls 5, 6 of the upper section 1 are impressed within the front portion of the upper section 1 surrounded by the front cover 3 so that the outer sides of the upper wall of the front cover 3 and the rear parts of the upper wall of the upper section 1 will lie in the same plane when the front cover 3 is slid onto the upper section 1. The impression edge 15 is shown for side walls 5 and 6 in FIG. 1 and for upper wall 4 in FIG. 2, which also shows how the upper wall of the front cover lies in the same plane as the rear part of the upper wall 4 of the upper section 1.

The kitchen ventilator is intended to be hung under a cupboard or console above a kitchen stove. For this purpose, the upper wall 4 of the upper section 1 is provided with holes placed in a suitable manner for attachment screws. FIG. 1*a* shows an embodiment having four holes 16 of which two are hidden by the wall 6.

Figure 2:
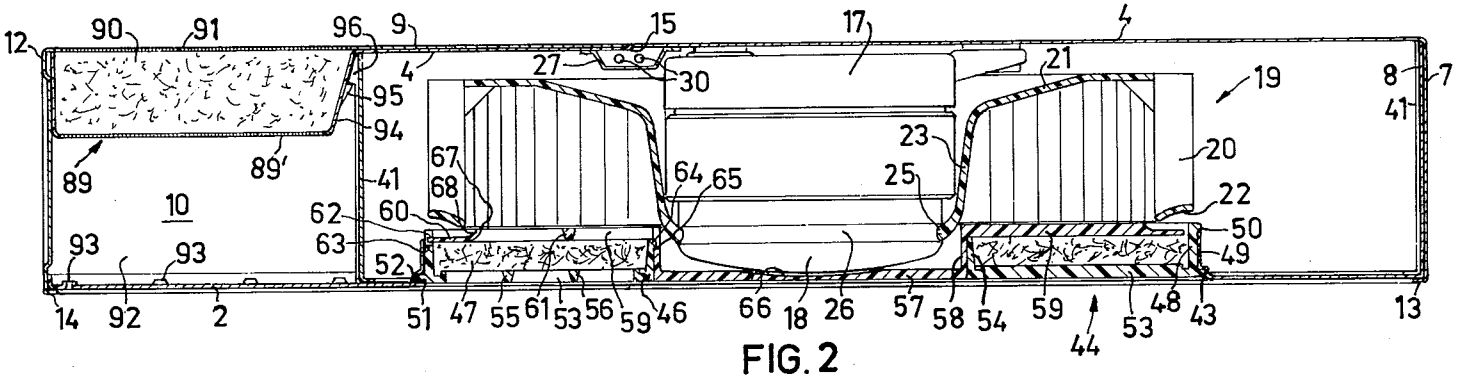
FIG. 2 shows a cross section of the ventilator along line II—II in FIG. 1 but with the grease filter cut along line II—II in FIG. 3.

All of the electrical details are collected in the upper section 1. The electric motor 17 for the fan is screwed essentially centrally onto the bottom side of the upper wall 4; FIGS. 1 and 2. The motor rotor 18 supports a radial fan wheel 19 which comprises an outer rim of fan blades 20 which, in the operating position, stand vertically, said fan blades projecting out from a fan wheel disc 21. The free ends of the fan blades 20 are interconnected by a ring 22. The entire fan wheel 19 is designed as an integral unit of resilient plastic material, the inner portion of the fan wheel disc 21 being bent down to form a hub 23 which is provided with vertical slots 24. In this manner, the fan wheel 19 can be removably held onto the rotor 18 of the electric motor 17 by means of a bead 25 in the hub 23 resiliently engaging in an annular groove 26 in the rotor 18.

Current supply to the electric motor 17 takes place with the help of electric wires (not shown here) which are drawn through a passage formed by a metal plate channel 27 welded onto the bottom side of the upper wall 4 of the upper section 1. Said channel 27 extends transversely across a greater portion of the width of the upper section 1. A lamp holder 28 for a lightbulb 29 is attached to the left end of the channel 27. The electric wire 30 for current supply of the lamp is also drawn through the metal plate channel 27. In a corresponding manner, a lamp holder 31 for a lightbulb 32 is attached to the right end of said channel 27.

A portion of the right-hand section of the channel 27 and, optionally, the lamp holder 31 are surrounded by a box 33 made of sheet metal or plastic, said box 33 being connected to the upper wall 4 and having vertical side walls 34, a vertical front wall 35 and an essentially flat bottom 36. The box 33 extends from the channel 27 up to the forward edge of the upper section 1 and the front wall 35 of the box 33 lies in the same plane as the front edge of the upper section 1. The channel 27 is open in a manner not shown here inside the box 33. The box contains, for example, terminal blocks, switches and capacitors for connection and rpm-control of the fan motor 17 and connection of the lamps 29, 32. These components which are known per se are not shown in any detail in the drawing but FIG. 1 shows three pushbuttons 37 projecting from the front wall 35 of the box 33, said pushbuttons extending through an opening 37' in the front wall 12 of the front cover 3 and being used for control of the switch in the box 33. Current supply to the box 33 takes place with the help of an electric current supply wire 38 which is arranged in a plastic cable duct 39 extending straight back from the box 33 below the upper wall 4. The front end of the cable duct 39 is supported by the rear wall of the box 33 (not shown here). The rear end of the cable duct 39 extends through a hole in the area connection the rear wall 7 and upper wall 4 of the upper section 1 and is provided with an angular flange 40 which, from the outside, abuts said upper section walls; cf. FIG. 4. In this manner, the cable 38 can be drawn out of the upper section in a backward or upward direction without extending in the unused direction beyond the contour of the upper section 1.

The kitchen ventilator details intended for guiding air flow are essentially collected on the bottom plate 2. The fan housing is composed of a vertical sheet metal strip 41 (FIG. 1*b*) welded to the bottom plate 2 and bent in a spiral shape, one end of which is welded to the rear wall 3 of the bottom plate 2. The other end of the strip 41 lies at a distance from the back wall 8. The strip 41 has the same height as the back wall 8 and this height is adapted so that the upper edge of the strip sealingly abuts the upper wall 4 of the upper section when the bottom plate 2 is arranged in operating position in the upper section 1. The fan housing is restricted upwards by the upper wall 4 of the upper section 1, downwards by the bottom plate 2 and laterally by the sheet metal strip 41 which forms the fan housing wall. The outlet opening of the fan housing is formed between the free end of the strip 41 and the rear wall 8. The upper edge of the strip 41 is provided with recesses 42 intended to engage with and sealingly connect with the channel 27 of the upper section 1.

Figure 3:
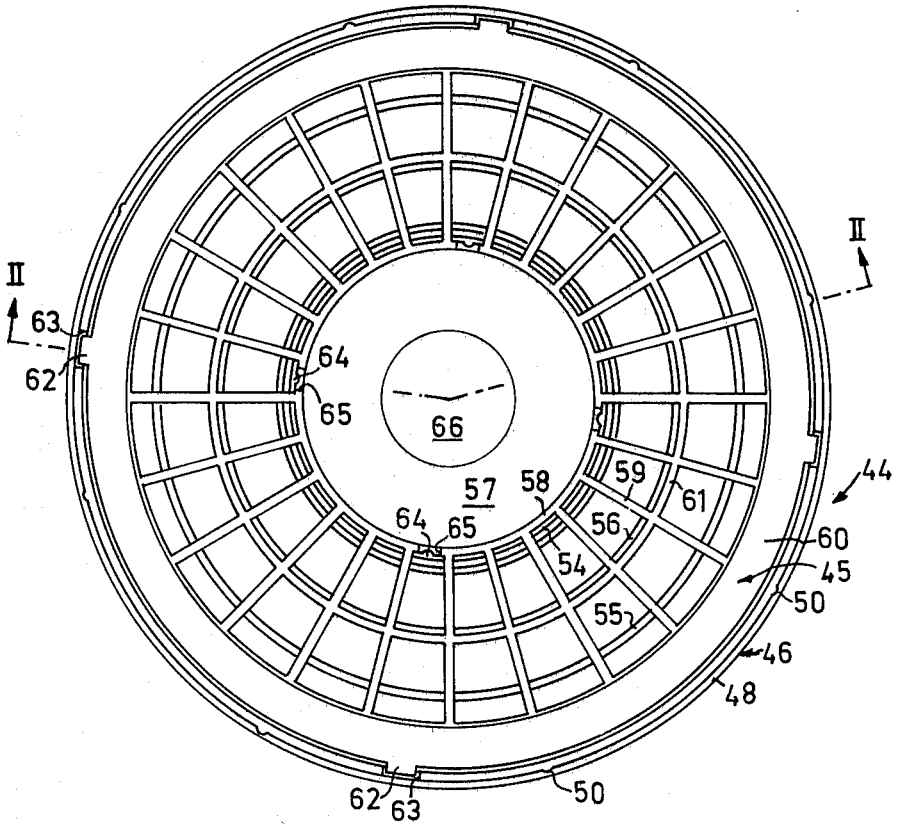
FIG. 3 shows the grease filter as seen from the inside of the ventilator.

Within the strip 41 forming the fan housing and centrally below the fan wheel 19 of the upper section, the bottom plate 2 is provided with an air intake opening 43 in which a grease collecting filter 44 is arranged. The grease filter 44 shown especially in FIGS. 2 and 3 is designed as a flat circular filter unit comprising an upper and a lower filter holder 45 and 46 respectively and an intermediate ring 47 of grease filtering material such as several layers of expanded metal, fiber material or porous plastic foam. The filter ring 47 rests upon the lower filter holder 46 which is designed as a spoke wheel without any center and having an axially directed wall 48 extending along its outer circumference, said wall 48 being intended to fit into a sheet metal rim 49 projecting up from the bottom plate 2. Like the upper filter holder 45, the lower filter holder 46 is composed of resilient plastic material and, at the upper edge of the wall 48, is provided with radially projecting nibs 50 which are uniformly distributed along the circumference and arranged to grip the upper edge of the rim 49 and thereby hold the filter unit 44 onto the bottom plate 2. The position of the filter unit 44 is defined by an annular flange 51 which projects radially from the lower edge of the wall 48 and engages an impression 52 between the bottom plate 2 and its rim 49. By means of radial spokes 53, the wall 48 is connected to an inner upright wall 54. The spokes are braced by two concentrical circular ribs 55 and 56.

The upper filter holder 45 has a central bowl-shaped part having an externally flat bottom 57 and an axially directed surrounding side wall 58. Radial spokes 59 project from the upper edge of the side wall 58, the outer ends of said spokes supporting an annular guide vane 60. The spokes are braced by a circular rib 61. The guide vane 60 is provided with radially projecting lugs 62 distributed along the circumference. Said lugs, in the assembled position of the filter 44, rest against the bottom of recesses 63 in the upper edge of the outer wall 48 of the lower filter holder 46. The upper filter holder 45 is held against the lower filter holder 46 by means of the upper edge of its inner wall 54 being provided with radially inwardly projecting nibs 64 distributed along the circumference and engaging the bottom of recesses 65 in the upper edge of the inner wall 58 of the upper filter holder 45. Thus, the entire filter unit 44 can be disassembled from the bottom plate 2 by means of the user inserting a pair of fingers through the openings between the spokes 53 and pulling the lower filter holder 46 downwards, whereby its outer wall 48 is resiliently bent inwardly so that the nibs 50 can psss the rim 49. In a corresponding manner, the upper filter holder 45 is removed from the lower filter holder 46 so that the filter ring 47 can be removed for cleaning or replacement. Assembly is effected by snapping the parts together in the converse order. The bottom 57 of the upper filter holder 45 is inwardly provided with a shallow circular recess 66 intended to provide space for the rotor 18 of the fan motor 17, said rotor extending almost all the way down to the lower plane of the bottom plate 2.

The inner diameter of the rim 49 projecting from the bottom plate 2 is so great that when the filter unit 44 is removed, the fan wheel 19 can be removed from the kitchen ventilator by means of being pulled down through the opening 43 in the bottom plate 2. The guide vane 60 of the upper filter holder 45 extends radially inwards so far that its soft, upwardly turned inner edge 67 is situated radially inside the fan blade ring 22 of the fan housing 19. Furthermore, the edge 67 projects radially inwards so far that it lies essentially in the same plane as or even inside the outermost axial restriction plane of the fan blade ring 22. In order that the ring 22 and the guide vane 60 shall not touch each other as a result of vibrations or the like, the axially inwardly-turned side of the guide vane 60 is provided with a circumferential recess 68. By means of this arrangement, a sort of labyrinth seal is formed and the air taken in through the filter 44 is led directly into the fan housing 19 without any loss and without any intermediate flow ducts.

A lamp housing 69 in the form of an upwardly and laterally open box having a front wall 70, a rear wall 71 and a side wall 72 is situated on the left-hand side of the bottom plate 2 (FIG. 1*b*). All of the walls stand up at right angles from a lamp housing bottom 73 which lies in the same plane as the bottom plate 2. The lamp housing 69 is an integral unit made of transparent plastic material and the bottom 73 is suitably impressed with a pattern. The lamp housing 69 is held onto the bottom plate 2 by means of it being provided with a groove extending along the lower edges of walls 70, 71 and 72, said groove sliding onto the plate edges of a rectangular recess arranged in the side of the bottom plate 2 (not shown here). The lamp housing walls are of the same height as the fan housing wall 41 and, thus, seal against the upper wall 4 of the upper section 1 when the bottom plate 2 is mounted into the upper part. The side wall 72 has a recess 74 for the channel 27.

In a corresponding manner, the right-hand portion of the bottom plate 2 is provided with a lamp housing 75 comprising a front wall 76, a rear wall 77, a side wall 78 and a bottom 79. The front wall 76 and the side wall 78 have a recess 80 intended to sealingly abut the connection box 33 and channel 27 of the upper section 1. The walls in general are of the same height as the fan housing wall 41 and, in the assembled state, abut the upper wall 4 of the upper section 1. The outer edge of the bottom 79 is provided with an upstanding stiffening ridge 81.

The rear wall 77 of the lamp housing 79 is softly curved 90° backwards and extends over the bottom plate 2 to sealing abutment against the rear wall 8 of said bottom plate. The rear wall 8 of the bottom plate 2 is provided with a rectangular opening 82 within the rear wall 77 of the lamp housing. Said opening 82 forms an air outlet opening from the fan housing. In the assembled state of the ventilator, the opening 82 lies directly opposite an opening 83 arranged in the rear wall 7 of the upper section 1, said upper section rear wall opening 83 forming a backwardly directed air outlet opening for the ventilator. An alternative, upwardly directed circular air outlet opening 84 is arranged in the upper wall 4 of the upper section 1 above the space which is defined by the bottom plate 2, its rear wall 8 and the rear wall 77 of the lamp housing. Air flowing from the fan housing flows along the rear wall 8 of the bottom plate to said space and can flow out through either of the air outlet openings 83, 84. Preferably both of these openings 83, 84 are sealed at delivery of the ventilator, for example, by means of the sheet metal pieces which have been cut out so as to form the openings not having been removed. Rather, they can remain attached to the upper section 1 by means of thin metal portions. When the ventilator is installed, the sheet metal piece which exposes the desired air outlet opening can then be broken away.

Figure 4:
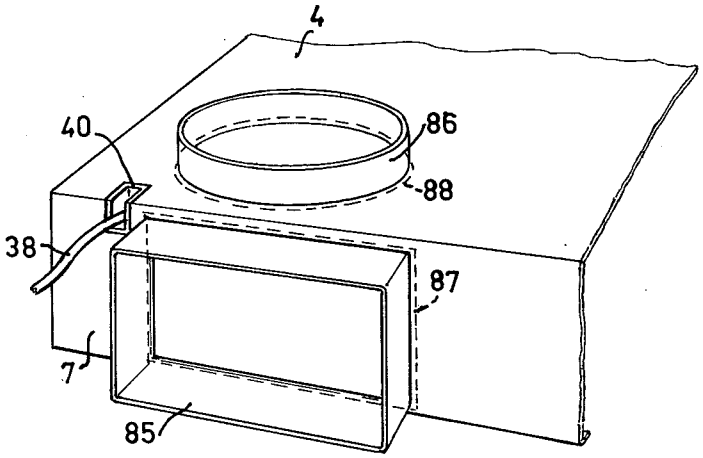
FIG. 4 is a rear perspective view of one rear corner of the ventilator, two alternative outlet openings being included therein.

Connection of the kitchen ventilator to an evacuation duct is effected by means of a loose connection piece. Preferably, two such connection pieces 85, 86 are provided, one for each air outlet opening 83, 84. The connection pieces 85, 86 are designed as rectangular and circular sheet metal pipe sections, respectively, and have a perpendicularly extending collar 37, 88 respectively. When the ventilator is assembled, the desired sheet metal piece is broken away so as to expose the intended outlet opening 83 or 84, after which the connection piece 85 or 86 respectively is inserted through the opening from the inside of the upper section 1 until the collar 87 or 88 respectively abuts the inside of the rear wall 7 or the upper wall 4 respectively. The evacuation duct is thereafter connected to the projecting portion of the connection piece. FIG. 4 shows both connection pieces 85, 86 assembled, but, naturally, only one or the other connection piece is intended to be used for any one installation. The axial length of the connecting piece 86 is at most so great that during storage and delivery of the ventilator, the connection piece can be stored in the space formed between the upper wall 4 of the upper section, the bottom plate 2, the fan housing wall 41 and the side wall 78 of the lamp housing 75. In a corresponding manner, the connection piece 85 can be stored in the space in front of the opening 82 in the rear wall 8 of the bottom plate 2. No air connection details project out beyond the contour of the box-like kitchen ventilator and, thus, it can be compactly packed.

The kitchen ventilator can also be used for blowing filtered recirculation air. For this purpose, the upper forward edge of the upper section 1 is provided with a trough 89 (FIG. 1, 2) extending between side walls 5 and 6. The trough is open upwardly and has a perforated bottom 89'. The trough 89 is intended to contain odor-removing filter material 90, for example, active carbon in a suitable cartridge or in loose form. The air outlet opening intended for recirculation air consists, in this case, of a field 91 of perforations arranged above the trough 89 in the upper wall 9 of the front cover 3 when said cover is pushed into its operating position. The filter trough 89 is fed with air from the fan housing 41 via an air chamber 92 which extends under the trough 89 and is defined by the side and front walls 10–12 of the front cover 3 and the bottom plate 2.

Inside the air chamber 92, the bottom plate 2 is provided with air outlet openings 93. These are formed by impressions made from below in the bottom plate 2, whereby the holes in the bottom plate 2 widen downwards. In this way, downwardly directed streams of air are produced in a manner known per se, said streams of air forming an air curtain which screens off the area under the kitchen ventilator and thereby prevents vapors from the kitchen stove from flowing laterally outside of the kitchen ventilator.

Both ends of the rear wall 94 of the trough 89 are provided with a downwardly-backwardly embossed sheet metal tongue 95. Said tongue forms a hooking means which cooperates with a locking boss 96 arranged on the upper end of the forward wall 70 and 76 respectively of both of the lamp housings 69 and 75 respectively. When the bottom plate 2 shall be mounted in the upper section 1, the bottom plate is placed with its rear edge on the ledge 13, after which it is swung up so that the locking bosses 96 pass over the plate tongues 95 by means of the walls 70, 76 springing backwards. The bottom plate 2 is held provisionally in this manner in an uplifted position until the front cover 3 is mounted and locks the bottom plate 2. During disassembly of the bottom plate 2, the front walls 70, 76 of the lamp housing are pressed backwards until the locking bosses 96 pass freely behind the tongues 95, after which the bottom plate can be swung and removed.

Figure 5:
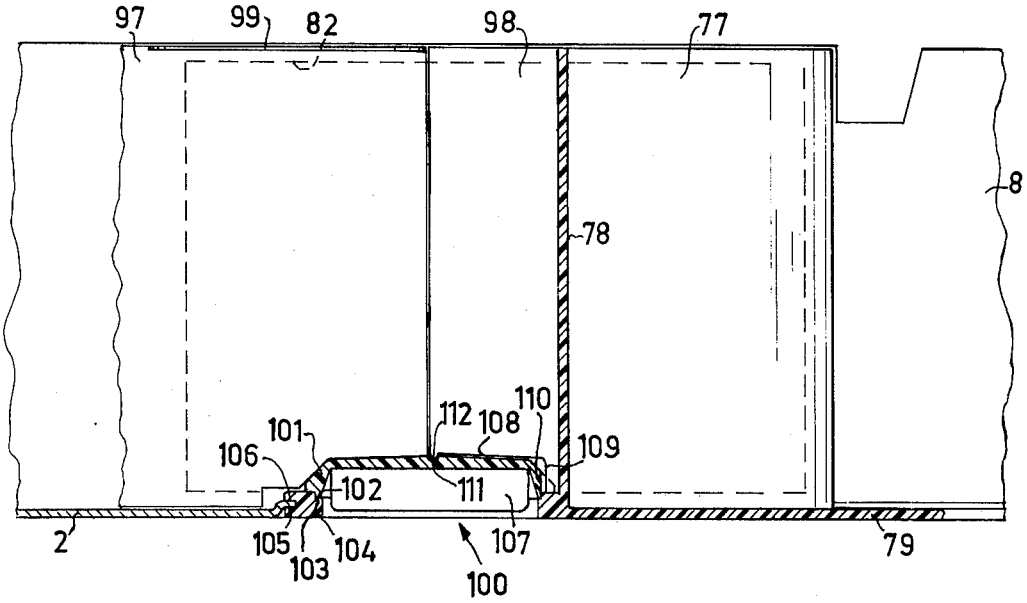
FIG. 5 shows the valve and valve operating means of the ventilator as seen in a vertical section along the line V—V in FIG. 1.
Figure 6:
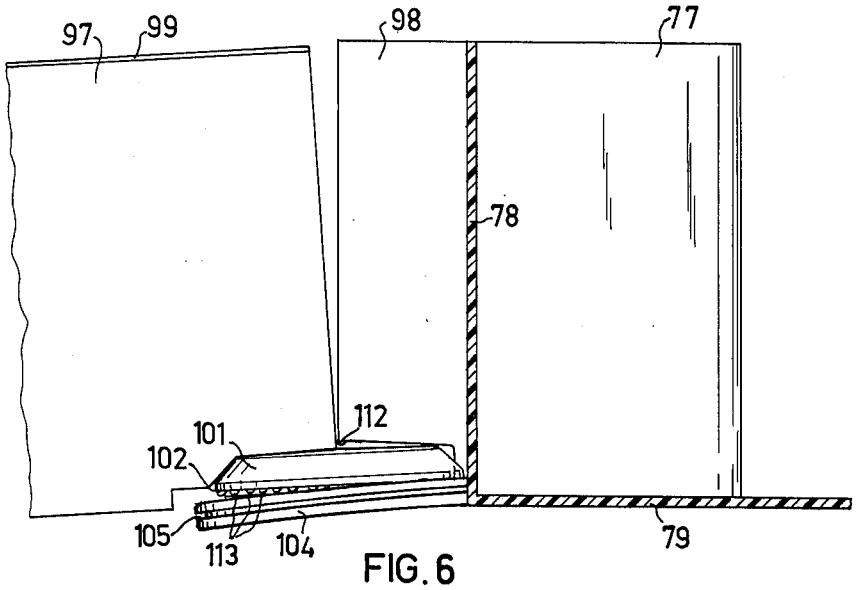
FIG. 6 shows essentially the same view when the valve is being disassembled.

The air flowing out from the fan housing can be led either to the outlet openings 83, 84 for evacuation or to the filter trough 89 and outlet opening 91 for recirculation or it can be distributed in a desired manner to both of these outlet openings 83, 84 and 91 respectively. Distribution is effected by means of a valve which can be manually adjusted from below the ventilator. Said valve is shown in FIGS. 1*b*, 5 and 6. The valve which is connected to the bottom plate 2 comprises a valve flap 97 arranged perpendicular to the bottom plate 2 between the fan housing wall 41 and a wing 98 projecting out from the side wall 78 of the lamp housing 77 and designed as an extension of the rear wall 77 of the lamp housing. The valve flap 97 has the same height as the fan housing wall 41 and is pivotable about a vertical axis line along that edge of the valve flap which is situated nearest the wing 98. In the valve flap 97 position illustrated by solid lines in FIG. 1*b*, the valve flap outer edge sealingly abuts the fan housing wall 41 and thereby blocks the air flow to the air chamber 92. The second end position of the valve flap 97 is illustrated by dot-dash lines, in which position the free edge of the valve flap sealingly abuts the rear wall 8 of the bottom plate 2 and thereby blocks the flow of air into the evacuation openings 83, 84. Adjacent its axis line, the valve flap 97 is provided with a circle segment flange 99 projecting perpendicularly towards the fan housing from the upper edge of said valve flap. In the position illustrated by the dot-dash lines, the circle segment flange seals a portion of the air outlet opening 84 situated above the straight valve flap 97 so that said opening is totally closed.

FIG. 5 shows a vertical section drawn through the side wall 78 and bottom 79 of the lamp housing 75 and the bottom plate 2 and a handle 100 for turning the valve flap 97. The handle 100 comprises a circular bowl 101 which is formed integrally with the valve flap 97 and opens downwards, the lower annular edge 102 of said bowl abutting an annular seat 103 arranged in a lateral extension 104 of the bottom 79 of the lamp housing 75. The extension 104, as the rest of the lamp housing, has a circumferential groove 105 in which a raised edge 106 of the bottom plate engages so that the bottom face of the extension 104 and the bottom 79 of the lamp housing lie in the same plane as the bottom face of the bottom plate 2. The lamp housing 69 also has a corresponding arrangement. A diametrical wall 107 is arranged in the bowl 101, said diametrical wall lying within the plane of the bottom 79 and forming a finger-grip for turning the bowl 101. The wing 98 extends over the bowl 101 and the bottom edge of said wing is provided with a recess 108 which seals against the upper side of the bowl 101 and has an edge 109 extending adjacent to the wall 78 and projecting into a circle-arc-shaped recess 110 in the outer periphery of the bowl 101. When the bowl 101 is turned, the end edges of said recess will abut the wing edge 109, whereby the turning range of the bowl 101 is restricted.

The lamp housing 75 and thus the bottom extension 104 of the same are composed of a resilient material. This property is utilized in order to make possible assembly and disassembly of the valve flap 97 and to provide the same with snap rest positions within its pivoting range. FIG. 6 shows the lamp housing 75 removed from the bottom plate 2. The extension 104 can then be bent downwards in the shown manner so that the annular edge 102 of the bowl 101 passes freely over the seat 103 simultaneously as a central recess 111 (FIG. 5) in the center of the upper face of the bowl 101 passes freely under a pin 112 arranged at the bottom edge of the free edge of the wing 98. The bowl 101 can then be laterally withdrawn from its operational position between the extension 104 and the wing 98. FIG. 6 reveals that the lower annular edge 102 of the bowl 101 is provided with a collar of downwardly directed projections 113 arranged to cooperate with depressions (not shown here) in the seat 103. Due to the resilient properties of the extenison 104 and the wing 98, snap positions are formed for the various angular settings of the valve flap 97.

Nor do the operating members of the damper project beyond the smooth side surfaces of the box-like kitchen ventilator. Only the switch buttons 37 and the current supply cable 38 project beyond the flat outer contours of the kitchen ventilator and, thus, said ventilator is easily compactly packed. The kitchen ventilator forms a rigid, pressure resistant unit due to the fact that the sheet metal strip 41 of the fan housing, the walls 70–72 and 76–78 of the lamp housing and the valve flap 97 span the entire distance between the bottom plate 2 and the upper wall 4 of the upper section 1. Furthermore, the forward portion of the kitchen ventilator can be made more rigid during transport by means of the connection shoulder 86 having such a height that it fits precisely in between the bottom plate 2 and the bottom 89' of the filter trough 89.

What we claim is:

1. A kitchen ventilator comprising: a housing intended especially to be mounted above a kitchen stove, said housing having an air intake opening therein; a fan for drawing in air through the air intake opening; a first air duct leading air from the fan to a first outlet opening for discharging air from the room in which the kitchen ventilator is mounted; a second air duct leading air from the fan to a second outlet opening which is in communication with the room, said second air duct having an odor removing filter; and valve means for leading air from the fan selectively to the first or second air ducts, said housing having at least one downwardly directed third outlet opening for producing a downwardly flowing air curtain, said third outlet opening communicating with a portion of the second duct between the valve means and the odor removing filter.

2. A kitchen ventilator as in claim 1 wherein the second air duct comprises an air chamber running along the front edge of the housing, the bottom of which chamber is defined by a bottom plate of the housing, and wherein said third outlet opening is provided in the bottom plate near the front edge thereof.

3. A kitchen ventilator as in claim 2 wherein a plurality of downwardly widening air curtain outlet openings are arranged in the bottom plate along the front edge of the same.

4. A kitchen ventilator as in claim 2 wherein the top of the air chamber is at least partially defined by the bottom of a holder for the odor removal filter situated near the upper wall of the housing, said bottom being provided with air flow-through openings.

5. A kitchen ventilator comprising: a housing having therein an intake opening and first, second and third outlet openings; a fan in said housing for drawing room air through the intake opening and into the housing; means in said housing forming a first air duct leading air from the fan and discharging such air through said first outlet opening, said first outlet opening being adapted to be connected to an external duct for passing the discharged air to a location outside the room; means in said housing forming a second air duct leading air from the fan and discharging such air through said second outlet, said second outlet being in communication with the room; an odor removing filter in said second air duct; and valve means operable from outside said housing for selectively controlling the flow of air from the fan to said first and second air ducts, said third outlet opening being in communication with the room and with a portion of said second air duct between said valve means and said odor removing filtered and said third outlet opening being directed downwardly for producing a downwardly flowing air curtain.

* * * * *